United States Patent [19]

Hansen

[11] 4,323,335

[45] Apr. 6, 1982

[54] DISTRIBUTOR VALVE FOR HYDRAULIC PLANETARY PISTON MACHINE

[75] Inventor: Christian B. Hansen, Nordborg, Denmark

[73] Assignee: Danfoss A/S, Nordborg, Denmark

[21] Appl. No.: 125,504

[22] Filed: Feb. 28, 1980

[51] Int. Cl.[3] ..... F01C 1/10; F01C 21/12; F03C 2/08

[52] U.S. Cl. ..... 418/61 B; 137/625.24

[58] Field of Search ..... 418/61 B; 60/384, 386; 137/596, 625.24

[56] References Cited

U.S. PATENT DOCUMENTS

| | | | |
|---|---|---|---|
| 3,435,851 | 4/1969 | Olmsted | 137/625.48 |
| 3,579,984 | 5/1971 | Rohde | 60/384 |
| 4,106,883 | 8/1978 | Hansen et al. | 418/61 B |

*Primary Examiner*—John J. Vrablik
*Attorney, Agent, or Firm*—Wayne B. Easton

[57] ABSTRACT

The invention relates to a hydraulic planetary piston type machine and particularly to the rotary slide valve thereof. This type of machine has a rotary piston gear having rotational and orbital movement and a cardan type shaft connects the slide valve to the piston gear. The valve has inlet and outlet, annularly shaped, axially spaced distributor grooves in axially spaced relation. Alternately arranged inlet and outlet stub grooves extend axially from the distributor grooves into axially overlapping relation. The stub grooves in the valve have a commuting action with circumferentially arranged ports in the casing to provide for feeding and exhausting pressurized fluid to and from expanding and contracting chambers formed by the piston gear. In smaller machines the correspondingly smaller flow passages present sufficient flow resistance to substantially affect the efficiency of the machine. In the machine disclosed herein the stub grooves are provided with oblique or curved sections so that the resistance to fluid flow between the distributor grooves and the stub passages is reduced and the efficiency of the machine is thereby substantially increased.

2 Claims, 3 Drawing Figures

DISTRIBUTOR VALVE FOR HYDRAULIC PLANETARY PISTON MACHINE

Figure 1:
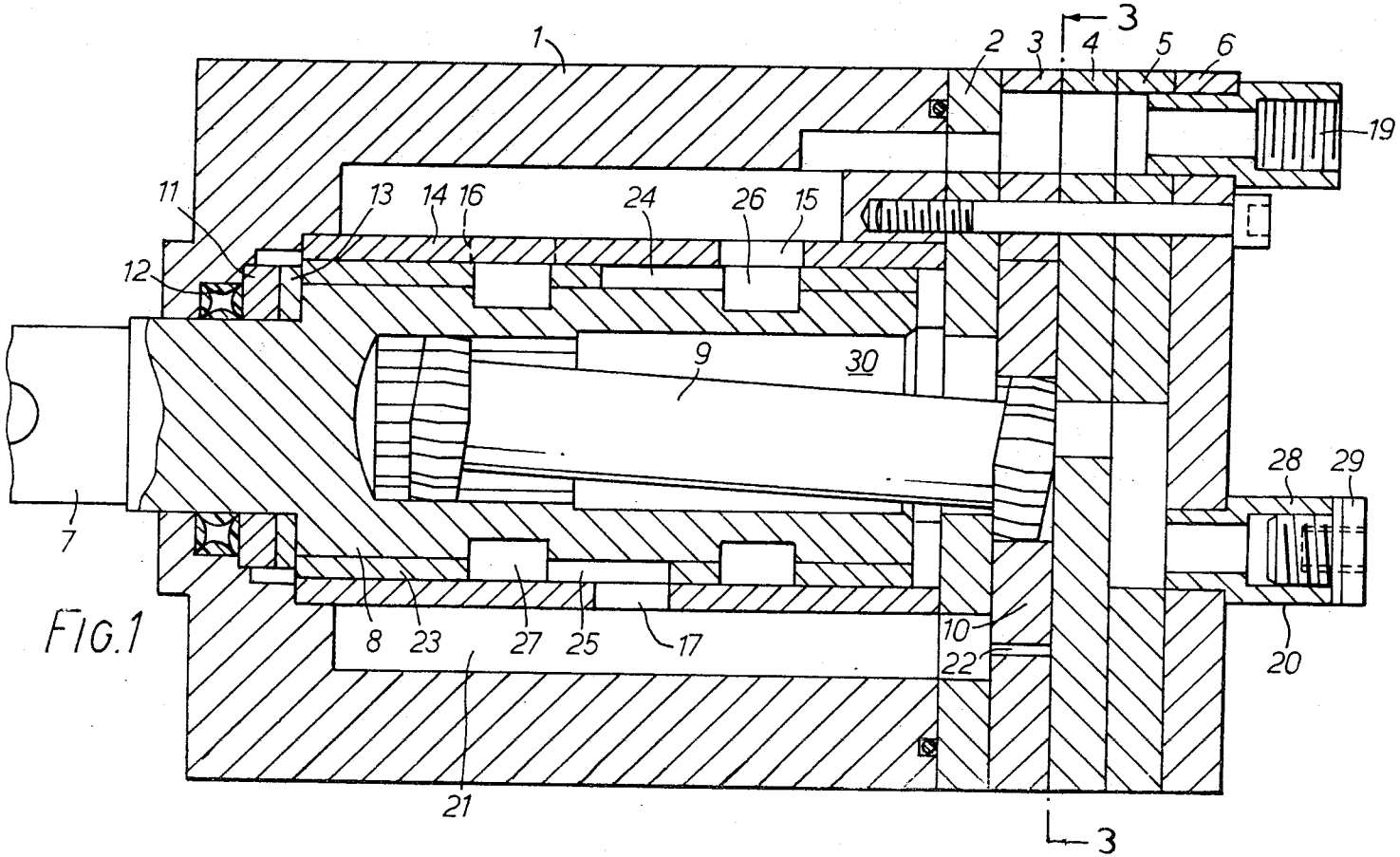

The invention relates to a distributor valve for a hydraulic planetary piston machine, particularly an engine, with internal shaft and meshing engagement, wherein a rotary slide valve turning with the main shaft comprises two annular grooves each connected to the inlet and outlet and alternately arranged inlet and outlet distributor grooves which extend from both annular grooves transversely thereto and co-operate with control apertures fixed with respect to the housing and each leading to a compression chamber.

In known distributor valves of this kind, the outer periphery of a rotary valve sleeve comprises two axially offset annular grooves and axially directed distributor grooves adjoining same at right-angles thereto (DE-AS 15 53 004). When planetary piston machines equipped with such distributor valves are operated, their efficiency drops when they run in the upper range of rotary speed. This is particularly so if the hydraulic planetary piston machine is to have very small overall dimensions, e.g. a housing with a length of only 10 cm and a diameter of only 6 cm.

Further, disc-shaped rotary valves are known in which radially extending distributor grooves alternately communicate with an inner and an outer annular groove. The same disadvantages apply in this case.

It is also known (DE-OS 26 08 887) to have the distributor grooves at the outside of a rotary valve sleeve extending at a small angle of 3 to 8° to the axial direction instead of precisely parallel thereto. In this way each distributor groove can gradually communicate with an axially extending control aperture so that pressure pulses are avoided.

The invention is based on the problem of providing a distributor valve of the aforementioned kind, with the aid of which the efficiency of hydraulic planetary machines can be improved, particularly in the upper speed range and with very small dimensions.

This problem is solved according to the invention in that each inlet distributor groove is connected by an oblique inlet section to a position of the annular groove that is offset in the direction of rotation.

In this way, a paddling or deflecting effect is obtained for the hydraulic liquid entering the inlet distributor grooves, thereby improving the entire flow. The deflection losses are reduced and the degree of filling the groove is increased. This feature becomes particularly marked at higher rotary speeds because the planetary piston machines here in question may be regarded as slow-running but nevertheless have a very high throughput of pressure fluid. The effect is also obtained in machines of very small dimensions because in this case, because of the spatial conditions, the grooves have a correspondingly small flow cross-section with a correspondingly high flow resistance.

It is favourable if each outlet distributor groove is connected by an oblique outlet section to a position of the annular groove that is offset opposite to the direction of rotation. This will bring advantages in the outlet region similar to those in the inlet region. In addition, such a machine can be operated as a motor or pump in both directions of rotation with equal success, the only difference being that the inlet and outlet sections have respectively opposite functions.

Further, the oblique sections may be curved. This will give optimum flow in the deflecting zone.

Figure 2:
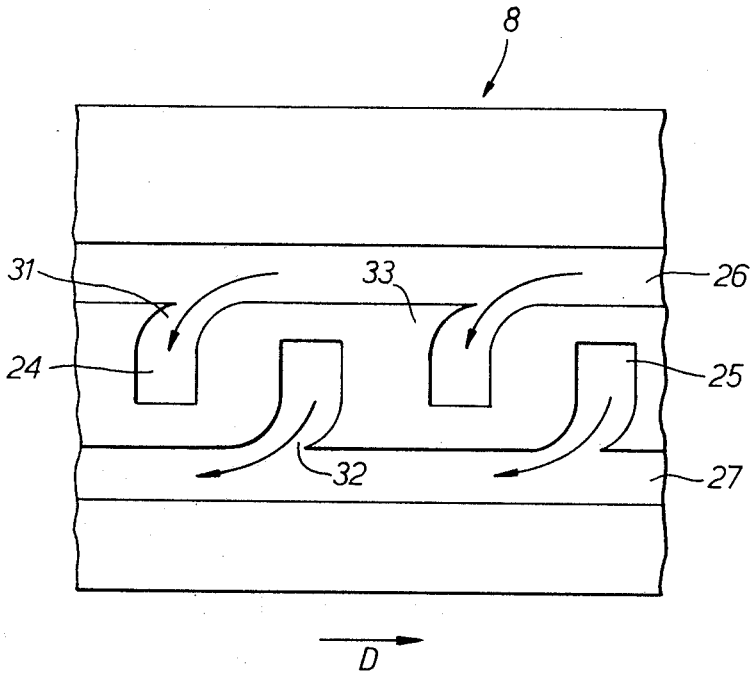
Figure 3:
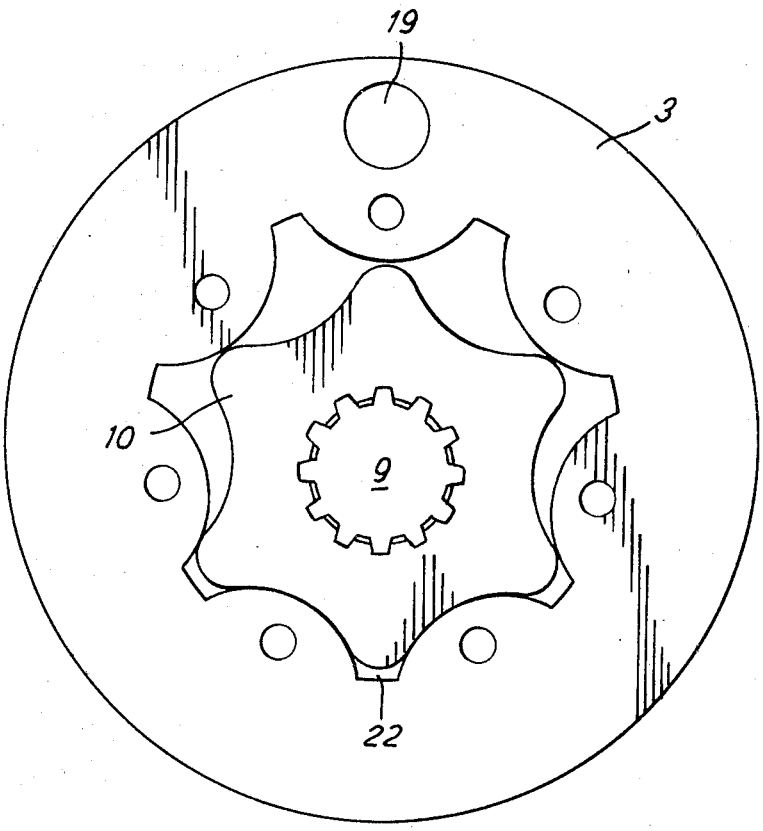

The invention will now be described in more detail with reference to an example illustrated in the drawing, wherein:

FIG. 1 is a longitudinal section through a hydraulic planetary piston machine with a distributor valve constructed in accordance with the invention, FIG. 2 is a development of the peripheral surface of the distributor valve; and FIG. 3 is a sectional view taken on line 3—3 of FIG. 1.

In the planetary piston machine shown in FIG. 1, which is particularly operated as a motor, the housing has a cupped main portion 1, an intermediate plate 2, a gear ring 3, a further intermediate plate 4 as well as an inner cover plate 5 and an outer cover plate 6. These components are interconnected by means of axial screws (not shown). A drive shaft 7 is made in one piece with a rotary valve 8 and connected to a gear 10 by a cardan shaft 9. A bearing disc 11 inserted in the base of the main portion and simultaneously serving to retain a seal 12 forms an axial bearing together with a bearing plate 13 secured to the rotary valve 8.

The cupped main portion is provided in the inside with a sleeve 14 comprising an inlet aperture 15, an outlet aperture 16 beyond the plane of the drawing, and control apertures 17 therebetween. The inlet aperture 15 is connected by a passage 18 in the housing to a connector 19 and the outlet aperture 16 is connected to a connector 20 by an outlet passage disposed beyond the plane of the drawing. The control apertures 17 are connected by a respective housing passage 21 to compression chambers 22 formed between the teeth of the gear 10 and gear ring 3. The housing passages 21 each open between two teeth of the gear ring; their number is therefore equal to the number of teeth on the gear.

On the outside of the rotary valve 8 there is likewise a sleeve 23. It is provided with alternate distributor grooves 24 and 25 of which the inlet distributor grooves are connected to an annular groove 26 in communication with the inlet aperture 15 and the outlet distributor grooves 25 are connected to an outlet annular groove 27 in communication with the outlet aperture 16.

A further connector 28 is closed by a screw 29. It may serve to relieve the interior 30 of the rotary valve 8 by connecting it to a tank.

FIG. 2 shows that the inlet distributor grooves 24 are connected by an arcuately extending oblique inlet section 31 to a position of the annular groove 26 which is offset from the distributor groove in the direction of rotation D. Similarly, the outlet distributor grooves 25 are provided with an arcuate oblique section 32 opening into the annular groove 27 at a position which is offset from the distributor groove against the direction of rotation D. Consequently, points 33 are produced on the inlet side that, during operation, exert a scoop effect on the arriving pressure fluid, whereby the flow conditions are improved during deflection and flow losses are reduced. Similar improvements are obtained on the outlet side.

In this way one can produce extraordinarily small hydraulic motors in which the rotary valve has a length of less than 6 cm and a diameter of only 3.5 cm and having a very good efficiency despite the inevitably small cross-sections of the grooves.

By using the sleeve 23, the curved inlet and outlet sections 31 and 32 can be readily produced, e.g. by means of a finger milling cutter. The machine can be operated as a pump as well as a motor.

What is claimed:

1. A hydraulic planetary piston machine comprising, a casing, a rotary piston gear in said casing having rotational and orbital movement, a main shaft and a rotary cylindrically surfaced slide valve rotatably mounted in said casing, a cardan shaft having a predetermined direction of rotation connected between said piston gear and said slide valve, said slide valve having two inlet and outlet annular distributor grooves in axially spaced relation, alternately arranged inlet and outlet stub grooves respectively extending axially from and at right angles to said distributor grooves into axially overlapping relation, said inlet stub grooves having curved sections connecting them to said inlet distributor groove, said curved sections being curved towards said predetermined direction of rotation to achieve a scooping effect relative to the ingressing fluid.

2. A hydraulic planetary piston machine according to claim 1 wherein said outlet stub grooves have oppositely curved sections connecting them to said outlet distributor groove.

* * * * *